United States Patent [19]

Quick

[11] Patent Number: 4,598,477

[45] Date of Patent: Jul. 8, 1986

[54] CUTTING DEVICE

[75] Inventor: Nicholas J. Quick, Birmingham, England

[73] Assignee: Russell (Shears) Limited, Rawmarsh, England

[21] Appl. No.: 537,448

[22] Filed: Sep. 30, 1983

[30] Foreign Application Priority Data

Oct. 5, 1982 [GB] United Kingdom ..... 8228354

[51] Int. Cl.[4] ..... B26B 13/16; B26B 13/06; B26B 13/04

[52] U.S. Cl. ..... 30/260; 30/268; 30/269

[58] Field of Search ..... 30/260, 266, 268, 269, 30/270, 341

[56] References Cited

U.S. PATENT DOCUMENTS

| | | | |
|---|---|---|---|
| 558,494 | 4/1896 | Johnson | 30/269 |
| 791,590 | 6/1905 | Stull | 30/268 |
| 828,303 | 8/1906 | Clauss | 30/268 |
| 843,667 | 2/1907 | Davies | 30/269 |
| 895,444 | 8/1908 | Feinenburg | 30/269 |
| 2,647,314 | 8/1953 | Gilson | 30/349 |
| 2,682,108 | 6/1954 | Shaler | 30/260 |
| 4,048,721 | 9/1977 | Gunson | 30/268 |

FOREIGN PATENT DOCUMENTS

| | | | |
|---|---|---|---|
| 10605 | 7/1889 | United Kingdom | 30/268 |

*Primary Examiner*—Paul A. Bell
*Assistant Examiner*—Paul M. Heyrana, Sr.
*Attorney, Agent, or Firm*—Fleit, Jacobson, Cohn & Price

[57] ABSTRACT

A cutting device comprising first and second members each comprising a blade at one end and a handle at the other end, a pin on which the first and second members are pivotted so that the blades work with a scissor action for cutting purposes, and a clip which extends longitudinally along an outside face of one of the first and second members, the cutting device being such that the first and second members are retained on the pin between an abutment part at one end portion of the pin and the clip, the clip slides in a groove at the other end portion of the pin, the clip comprises a projection engaged in a complementary recess in one of the first and second members so as to hold the clip in a locking position on the pin, the clip further comprises a flat strip having at one end a slotted portion and at the other end the projection, the strip being bent on itself to define a limb parallel with the slotted portion and further bent so toward the slotted portion such that the projection extends substantially orthogonally of the slotted portion, and the cutting device being such that the first and second members are separable from each other by sliding the clip in the groove to a release portion.

8 Claims, 6 Drawing Figures

CUTTING DEVICE

This invention relates to cutting devices and more especially it relates to cutting devices operable with a scissor action.

In order to provide for efficient cutting with a cutting device such as scissors, shears or secateurs having a pair of blades pivoted about a common pivot, it should be arranged that the blades are held together tightly enough to facilitate a cutting operation but not so tightly as to prevent pivotal movement between the blades in response to relatively light pressure.

The present invention has for an object to provide a cutting device of the kind comprising two pivoted blades in which the blades are held together in a simple manner so as to facilitate efficient cutting and easy assembly and dis-assembly of the cutting device.

Accordingly, this invention provides a cutting device comprising first and second members each comprising a blade at one end and a handle at the other end, a pin on which the first and second members are pivotted so that the blades work with a scissor action for cutting purposes, and a clip which extends longitudinally along an outside face of one of the first and second members, the cutting device being such that the first and second members are retained on the pin between an abutment part at one end portion of the pin and the clip, the clip slides in a groove at the other end portion of the pin, the clip comprises a projection engaged in a complementary recess in one of the first and second members so as to hold the clip in a locking position on the pin, the clip further comprises a flat strip having at one end a slotted portion and at the other end the projection, the strip being bent back on itself to define a limb parallel with the slotted portion and further bent toward the slotted portion such that the projection extends substantially orthogonally of the slotted portion, and the cutting device being such that the first and second members are separable from each other by sliding the clip in the groove to a release position.

Preferably, the handle of the second member is cut away to define a pair of substantially parallel undercut grooves along which the clip is slidable.

Advantageously, the cutting device includes a raised portion which is positioned adjacent the complementary recess such that the projection is constrained to ride over the raised portion as the clip slides from the release position to the locking position.

The diameter of that end portion of the pin remote from the groove may be reduced to define a spigot which passes through a complementary hole in the blade of the first member, the end of the spigot being deformed into the abutment part so as to secure the blade of the first member to the pin.

In one embodiment of the invention, the slotted portion of the clip comprises an elongate slot which in the region of one end of the strip opens into a circular aperture large enough to clear the pin whereby the slotted portion can be slid onto the pin. In another embodiment of the invention, the slotted portion of the clip comprises an elongate slot open at one end and just wide enough to accommodate the pin.

The groove in the pin will usually be a circumferential groove.

The blades are preferably fitted in handles of a plastics material. Various types of mouldable plastics materials may be employed.

The blades may be replaceable blades. Each replaceable blade may be secured to its handle by the pin passing through a hole in the blade.

Some embodiments of the invention will now be described solely by way of example and with reference to the accompanying drawings in which.

Figure 1:
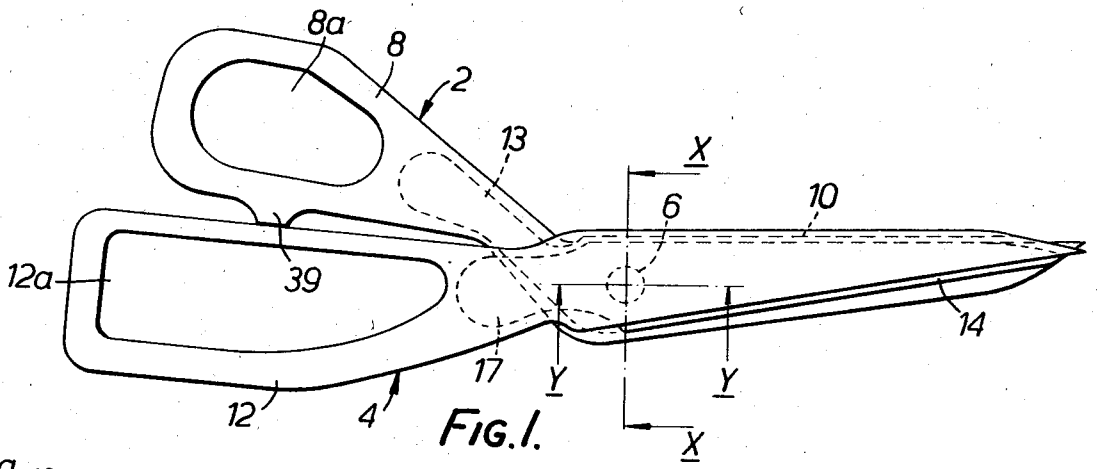
FIG. 1 is a front view of a pair of scissors.
Figure 3:
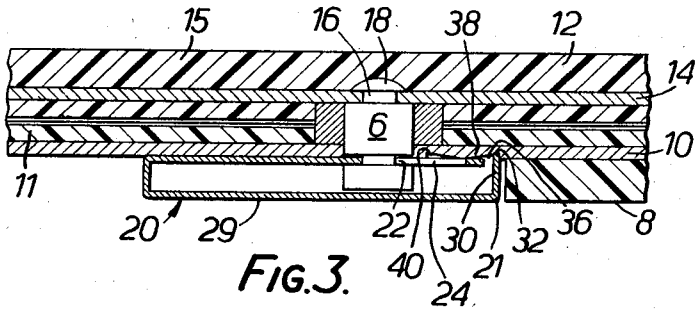
FIG. 3 is an enlarged sectional view through a line YY as shown in FIG. 1 of the scissors.
Figure 2:
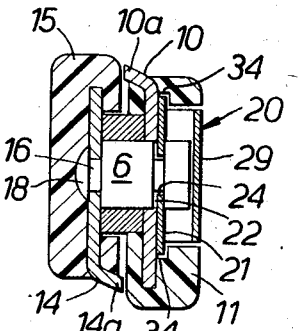
FIG. 2 is an enlarged sectional view through a line XX shown in FIG. 1 of the scissors.

Referring now to the drawings, a pair of scissors comprises a first member 2 and a second member 4 pivotted about a pin 6. The member 2 comprises a moulded plastics handle 8 and a steel blade 10. Similarly the member 4 comprises a moulded plastics handle 12 and a steel blade 14. The handle 8 has a thumb hole **8*a* and the handle 12 has a finger hole 12*a*. The blade 10 is embedded in plastics material 11 and the blade 10 is also provided with an extension piece 13 which extends into the handle 8 and around which the handle 8 is moulded. Similarly, the blade 14 is embedded in plastics material 15 and the blade 14 is also provided with an extension piece 17 which extends into the handle 12 and around which the handle 12 is moulded. Obviously, the cutting edges 10*a* and 14*a* of the blades 10,14 respectively extend out of the plastics material (as shown in FIG. 2) so that the blades 10,14** can effect their cutting action.

Figure 4:
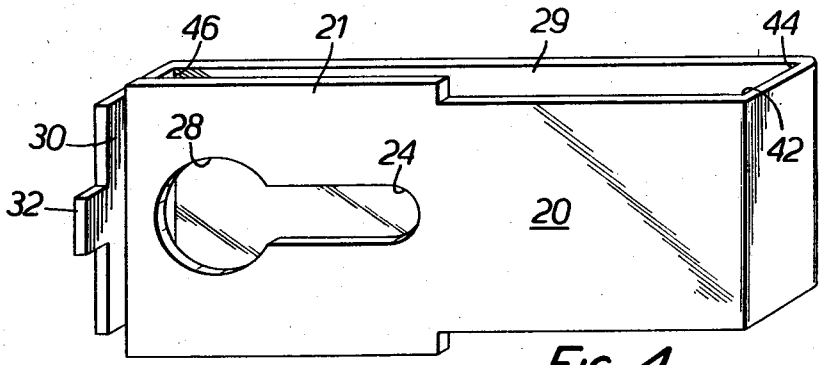
FIG. 4 is a perspective view of a clip for use with the scissors shown in FIGS. 1, 2 and 3.
Figure 5:
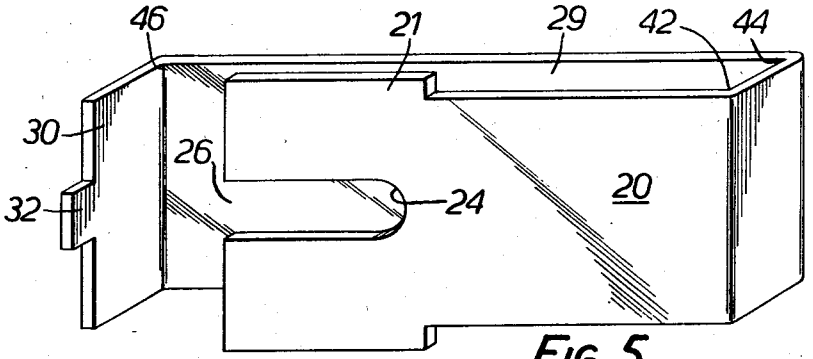
FIG. 5 is a perspective view of an alternate form of the clip shown in FIG. 4.
Figure 6:
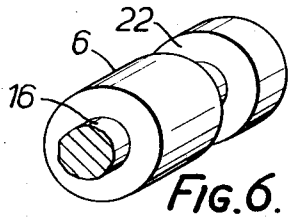
FIG. 6 is a perspective view of a pin for use with the scissors as shown in FIG. 1, FIG. 2 and FIG. 3.

The diameter of one end portion of the pin 6 is reduced to define a spiggot 16 on which the blade 14 is mounted, the spiggot 16 being peened or spun over to define an abutment part in the form of a rivet head 18. The rivet head 18 serves to secure the blade 14 in position on the pin 6. The blade 10 is held in position on the pin 6 by means of a slotted clip 20. The clip 20 is located in a circumferential groove 22 which is formed in the pin 6 at its other end portion. The clip 20 comprises a flat strip having a wider slotted end part 21 which includes an elongate slot 24 in which the pin 6 is accommodated. The slot 24 may either have an open end 26 as shown in FIG. 5 or may extend to define a circular aperture 28 as shown in FIG. 4. The clip 20 may be made of a metal such as spring steel.

In use of the clip 20 shown in FIG. 4, the circular aperture 28 is placed over the pin 6 whereby the slotted end part 21 of the clip 20 can be slid onto the complementary groove 22 in the pin 6. In use of the clip 20 shown in FIG. 5, since the slot 24 has an open end 26, the open end 26 facilitates positioning of the slotted end part 21 of the clip 20 in the groove 22 of the pin 6.

The strip material which defines the clip 20 is bent back on itself to form a limb 29 which lies parallel with the slotted end part 21 of the clip 20 and which is further bent to define an end portion 30 which includes a projection 32. The handle 8 in which the blade 10 is secured is provided with a pair of undercut grooves 34 in which the wider slotted end part 21 of the clip 20 is accommodated. The blade 10 is provided with a recess 36 in which the projection 32 is received to lock the clip 20 into position. The recess 36 is associated with a raised portion 38 which separates it from another recess 40. Thus the clip 20 may be constrained to slide from a first position whereat the projection 32 is engaged in the recess 40, to a second position whereat the projection 32 is engaged in the recess 36, the projection 32 being required to ride over the raised portion 38 as it is constrained to slide from the first to the second position.

It will be appreciated that if the clip 20 of FIG. 4 is used, when the clip 20 is in the first position, it may be removed from the pin 6 since the aperture 28 will align with the end of the pin 6. Alternatively, if the clip 20 as shown in FIG. 5 is used, the pin 6 will lie between the projection 32 and an end of the clip 20 when it is in the first position and thus will be clear of the slot 24 such that the scissors can be easily dismantled for sharpening purposes for example and also easily assembled during manufacture.

The handle 8 is provided with a stop member 39 which is effective to keep the handles 8,12 slightly apart during a cutting action and thereby to prevent a user of the scissors from trapping their skin between the handles 8,12 as the blades 10,14 close and cut.

The scissors as just before described may be used for any desired purposes so that they may be for example household scissors, hairdressing scissors, clothes making scissors, surgical scissors, or manicure scissors. It will however be appreciated that a cutting device utilising a clip as just before described for securing the blades in juxtaposed relationship may also comprise any other twin bladed cutting device such as shears or secateurs.

Various modifications may be made to the scissors hereinbefore described without departing from the scope of the invention and for example the scissors or some other twin bladed cutting device may comprise replaceable blades. Also, the extra width of the wider slotted end part 21 of the clip 20 could be continued to either of bends 42, 44 or 46 if desired. Further, different shapes may be employed for the pin 6.

I claim:

1. A cutting device comprising first and second members each comprising a blade at one end and a handle at the other end, a pin on which the first and second members are pivotted so that the blades work with a scissor action for cutting purposes, and a clip which extends longitudinally along an outside face of one of the first and second members, the cutting device being such that the first and second members are retained on the pin between an abutment part at one end portion of the pin and the clip, the clip slides in a groove at the other end of the pin, the clip comprises a projection engaged in a complementary recess in one of the first and second members so as to hold the clip in a locking position on the pin, the clip further comprises a flat strip having at one end a slotted portion and at the other end the projection, the strip being bent back on itself to define a limb parallel with the slotted portion and further bent towards the slotted portion such that the projection extends substantially orthogonally of the slotted portion, and the cutting device being such that the first and second members are separable from each other by sliding the clip in the groove to a release position.

2. A cutting device according to claim 1 in which the handle of the second member is cut away to define a pair of substantially parallel undercut grooves along which the clip is slidable.

3. A cutting device according to claim 2 and including a raised portion which is positioned adjacent the complementary recess such that the projection is constrained to ride over the raised portion as the clip slides from the release position to the locking position.

4. A cutting device according to claim 2 in which the diameter of that end portion of the pin remote from the groove is reduced to define a spigot which passes through a complementary hole in the blade of the first member, the end of the spigot being deformed into the abutment part so as to secure the blade of the first member of the pin.

5. A cutting device according to claim 1 in which the slotted portion of the clip comprises an elongate slot which in the region of one end of the strip opens into a circular aperture large enough to clear the pin whereby the slotted portion can be slid onto the pin.

6. A cutting pin according to claim 1 in which the slotted portion of the clip comprises an elongate slot open at one end and just wide enough to accommodate the pin.

7. A cutting device according to claim 4 in which the groove in the pin is a circumferential groove.

8. A cutting device according to claim 4 in which the blades are fitted in handles of a plastics material.

* * * * *